US006503174B2

(12) United States Patent
Mantooth

(10) Patent No.: US 6,503,174 B2
(45) Date of Patent: Jan. 7, 2003

(54) PIVOTING OVERHEAD HAND-OVER-HAND CLIMBING DEVICE

(75) Inventor: Charles Alan Mantooth, Stevenson, AL (US)

(73) Assignee: Playcore, Inc., Janesville, WI (US)

( * ) Notice: Subject to any disclaimer, the term of this patent is extended or adjusted under 35 U.S.C. 154(b) by 125 days.

(21) Appl. No.: 09/757,295

(22) Filed: Jan. 9, 2001

(65) Prior Publication Data

US 2002/0091041 A1 Jul. 11, 2002

(51) Int. Cl.[7] ..... A63B 7/00
(52) U.S. Cl. ..... 482/37; 482/36
(58) Field of Search ..... 482/37, 119, 36, 482/33, 34, 35, 23, 24

(56) References Cited

U.S. PATENT DOCUMENTS 239,970 A * 4/1881 Medart ..... 482/37
950,100 A * 2/1910 Gough ..... 482/37
5,145,472 A * 9/1992 Johnson, III et al. ..... 482/119

* cited by examiner

*Primary Examiner*—Stephen R. Crow
(74) *Attorney, Agent, or Firm*—Welsh & Katz, Ltd.

(57) ABSTRACT

An overhead hand-over-hand traversing apparatus, reminiscent of playground monkey bars, is provided. The apparatus has a single longitudinal bar with pivoting hubs at both ends and regularly spaced traversing hand holds, such that as the user traverses the bar, the bar pivots, to a limited degree, to provide fun and exercise while requiring agility. In a preferred embodiment, the traversing hand holds are in the form of generally U-shaped segments attached to the longitudinal bar. The traversing apparatus is supported by cross-bars intersecting the pivoting hubs at each end. The crossbars may then be independently supported such that the apparatus is a free-standing device or the apparatus may be connected such that it spans between two other play platforms and forms a bridge between the platforms or may form the entry to a single platform.

27 Claims, 4 Drawing Sheets

2
2
20
18
A
10
16
14
12
14a
16
14
20
14
S
18
A
2
22

46
13
38
44
18
38b
40
44
40b
46
40a
20
40a
38a
40b
44
46
40a
46

PIVOTING OVERHEAD HAND-OVER-HAND CLIMBING DEVICE

FIELD OF THE INVENTION

The present invention concerns a novel overhead hand-over-hand climbing device which pivots as the user progresses across the device. Specifically, the present invention is a piece of playground or gymnasium equipment used for fun and enjoyment and for the development of upper body strength and agility.

BACKGROUND OF THE INVENTION

Playground and backyard play equipment have traditionally included such play devices as swing-sets, tree houses, slides, teeter-totters, sand boxes and climbing equipment, such as jungle gyms and monkey bars on which children may entertain themselves. Typically, monkey bars comprise a ladder-like device placed horizontally overhead, generally spanning between two vertically placed, and fixed to the ground, ladders (or other platforms) on which the user first climbs to get onto the monkey bars. The user then progresses hand-over-hand from one end of the monkey bars to the other. The upper body is exercised in this manner and strength is required to successfully traverse the monkey bar span. For this reason, monkey bars are often also found in gymnasiums. Traversing, or walking, hand-over-hand, across the monkey bars, however, requires very little other skill and quickly becomes uninteresting causing the monkey bars, typically, to become a disused part of an overall gymnasium or playground set up.

I have invented an overhead traversing device that is reminiscent of traditional monkey bars but includes a novel twist in that it provides an extra element of movement to the traversing of the bars, requiring the users attention and agility to cross the length of the traversing device. The device of the present invention provides an added stimulus to the user, during use, that allows the device to hold the interest of the user longer than traditional monkey bars. The device is useful in both playgrounds and in gymnasiums, as upper body strength and agility are important at all stages of life. The design of the device is aesthetically pleasing, structurally strong and durable. Further, the design requires less material and fewer connections than traditional monkey bars such that it is more economical and is easier to manufacture.

It is therefore an object of the present invention to provide a recreation device and article of athletic equipment that, because of the added element of movement, keeps the users attention and encourages users to continue to play, and thus exercise, on the device.

It is a further object of the present invention to provide a gymnasium and recreation device that is pleasing to look at, structurally strong and durable.

It is a further object of the present invention to provide a gymnasium and recreation device that is easy to manufacture, requires less material than traditional recreation devices and fewer connection joints.

Other objects and advantages of the present invention will become apparent as the description proceeds.

SUMMARY OF THE INVENTION

In accordance with the present invention, an overhead hand-over-hand traversing apparatus comprising a longitudinal bar and hand holds is provided. The longitudinal bar defines an axis of rotation and a vertical plane, extending through the center of the bar generally perpendicular to the ground. The bar has a proximal end and a distal end and is supported at the ends; the bar also has a first pivoting hub and a second pivoting hub, respectively, at the proximal and distal ends.

A plurality of hand bars are also provided, spaced apart along the length of the longitudinal bar and placed alternately, on opposite sides of the vertical plane. In this manner a user can traverse the length of the longitudinal bar by first grasping one of the plurality of hand bars, near the proximal end of the longitudinal bar, with one hand, and then another of the plurality of hand bars with a another hand; subsequently releasing, one at a time, each grasped hand bar to grasp another of the plurality of hand bars.

The first and second pivoting hubs, at the ends of the longitudinal bar, allow the longitudinal bar to pivot about a limited angle of rotation on the longitudinal axis, as the user progresses along the longitudinal bar, grasping hand bars on opposite sides of the vertical plane. The pivoting of the bar causes the hand holds to drop, approximately 1 to 3 inches, as the bar is grasped and weight is applied. In this manner the user is provided with another dimension of movement and must exercise some agility to traverse the bar.

In one embodiment, the hand holds comprise generally U-shaped structural elements attached alternatively on both sides of the longitudinal bar. In a preferred embodiment pivoting hubs, comprising a sleeve having a rubber assembly which allows the longitudinal bar to pivot and then return, by spring action, to its initial, at rest, position.

A more detailed explanation of the invention is provided in the following description and claims and is illustrated in the accompanying drawings.

DETAILED DESCRIPTION OF THE ILLUSTRATIVE EMBODIMENT

Figure 1:
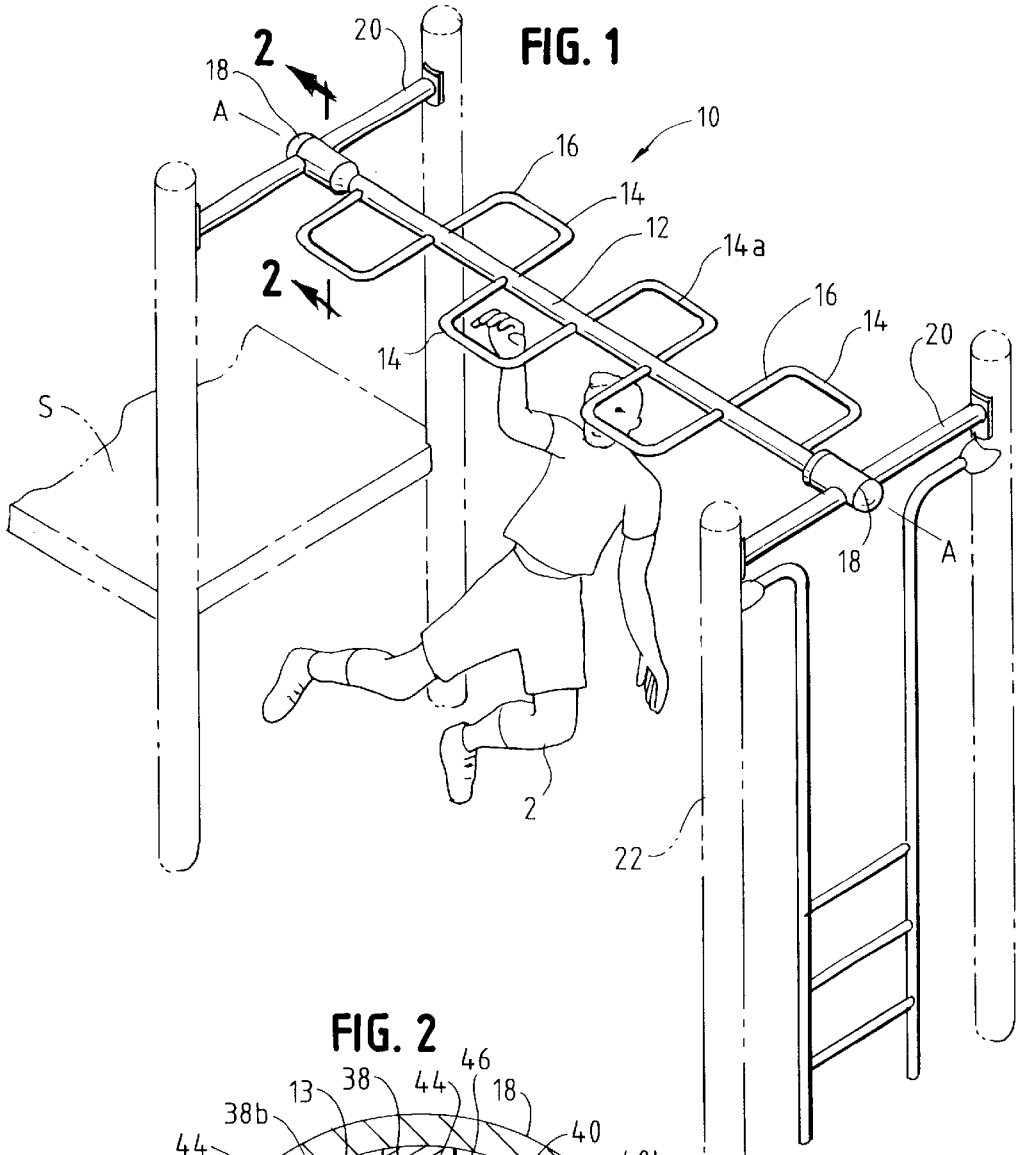
FIG. 1 is a perspective view of the recreation device of the present invention showing a child at play, with the device at a first, at rest, position.
Figure 2:
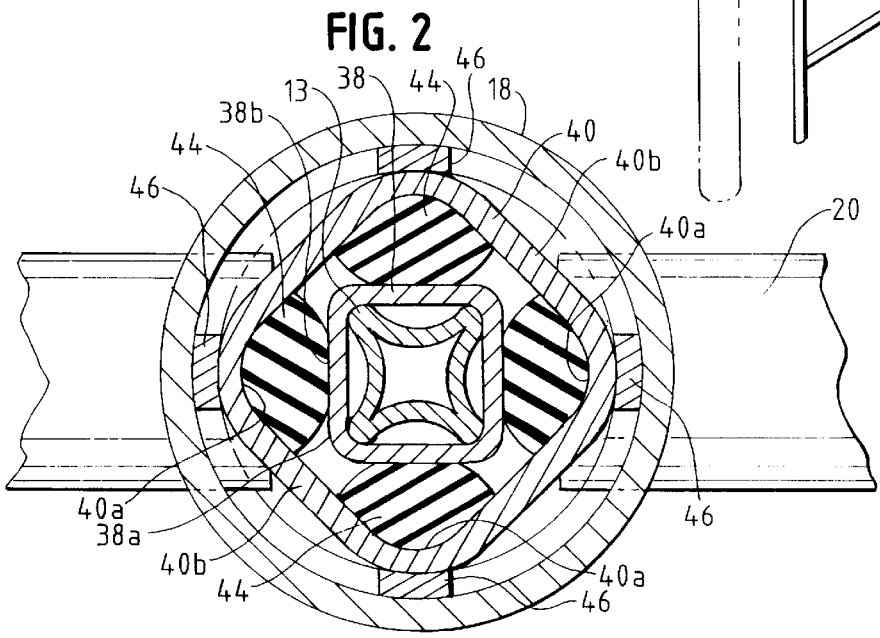
FIG. 2 is cross-sectional view, taken along the plane of line 2—2 of FIG. 1, showing a pivoting hub in a first, at rest position.
Figure 3:
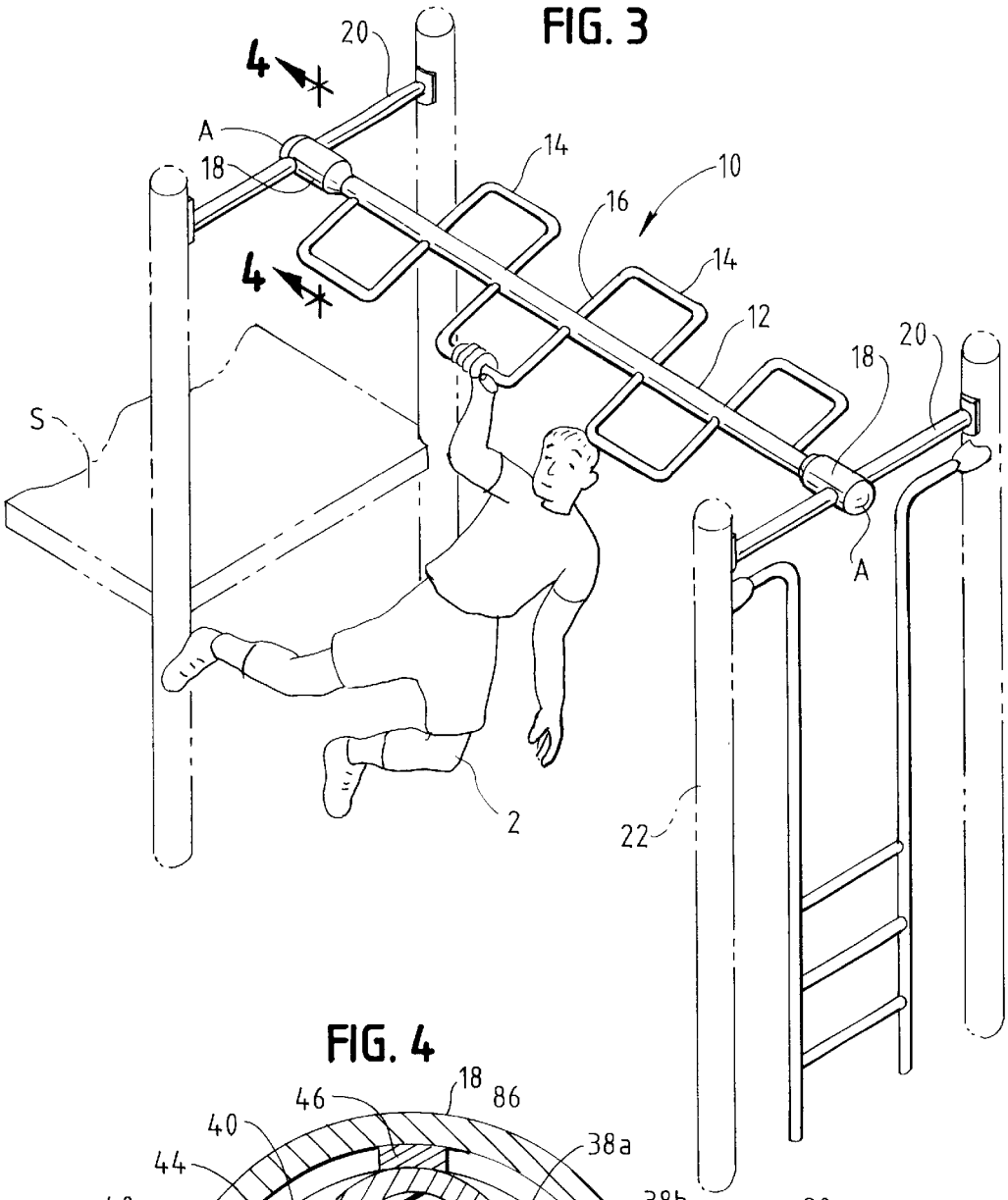
FIG. 3 is another perspective view of the recreation device of the present invention showing a child at play, with the device at a second, pivoted position.
Figure 4:
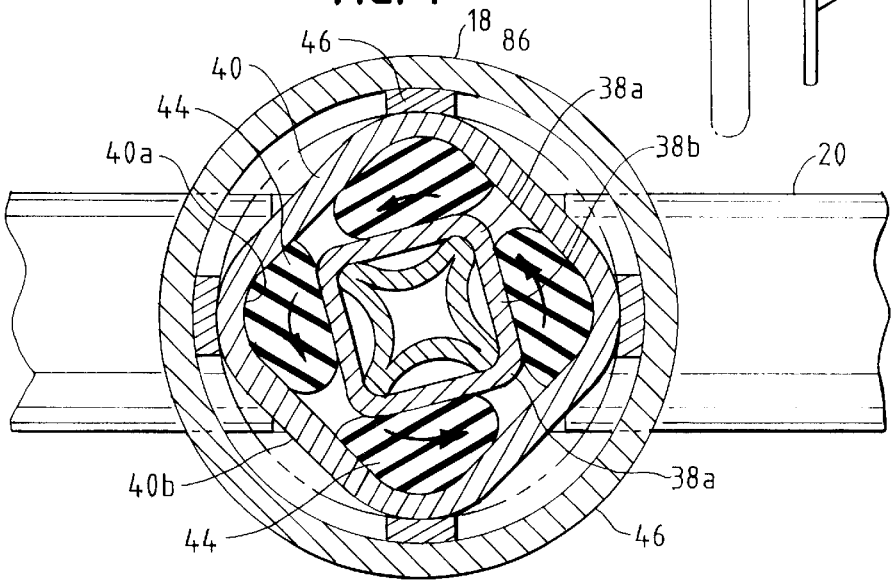
FIG. 4 is cross-sectional view, taken along the plane of line 3—3 of FIG. 3, showing a pivoting hub in a second, pivoted position.

Referring to the drawings, an overhead hand-over-hand climbing device 10 is shown. The device 10 includes a longitudinal bar 12, defining an axis A—A there-through, and a series of attached hand holds 14. In a preferred embodiment, longitudinal bar 12 is comprised of a structural tube into which an end bar 13 is attached at each end. End bars 13 having a generally star shaped cross-section, extend out from each end of longitudinal tube 12, such that longitudinal bar 12 is pivotally anchored into a support structure in a manner described below.

In a preferred embodiment, hand hold 14 are formed by a series of generally U-shaped bar segments 14*a* which are welded to longitudinal bar 12. The lateral portions 16 of generally U-shaped bar segments 14*a* form places onto which the user can grasp. In one embodiment longitudinal bar 12, comprised of a structural tube, defines a series of openings 12*a* into which the ends of U-shaped bar segments 14*a* are inserted and then firmly attached by welds. In another embodiment, U-shaped bar segments 14*a* are merely welded to the surface of longitudinal bar 12, which, as described below, may be comprised of any structural shape.

While welding is a preferred method of attachment of hand holds 14 to longitudinal bar 12, it is to be understood that any method of attachment, including by fasteners, adhesives and others, may be used without departing from the novel scope of the present invention. Further, where longitudinal bar 12 and hand holds 14 are made of other materials, attachment must typically be made by other methods. For example, if bar 12 and hand holds 14 are made of PVC (or other plastic) pipes, attachment would be made using plastic welding adhesives.

It will be understood that hand holds 14 may, in another embodiment, be made of a single continuous undulating curved bar 14*b* fabricated to appear that it is woven through the single longitudinal bar 12. Such an undulating bar 14*b* may be made to fit within a longitudinal bar 12, comprising a pipe divided in two parts along axis A—A (with handhold openings spaced to correspond to the lateral portions of an undulating bar). The two parts of such a bar can be welded together such that undulating bar 14*a* and longitudinal bar 12 function as a single member. It is, further, to be understood that any configuration of a longitudinal bar and hand holds, including one configuration have intermittently placed hand holds and one having handholds at a plurality of angles to one another, along the longitudinal axis A—A of the device, are contemplated and are not a departure from the novel scope of the present invention.

It is to be understood that while U-shaped bar segments 14*a* are a preferred embodiment, the use of a plurality of handholds (not shown), each comprised of a bar which traverses longitudinal bar 12, dividing hand holds (not shown) into two bars onto which a hand may grasp, may be made without departing from the novel scope of the present invention. Also, a plurality of handholds (not shown), comprised of a bar attached to, alternatively, different sides of longitudinal bar 12, maybe utilized without departing from the novel scope of the present invention.

Longitudinal bar 12 and handholds 14 may be made of any strong and rigid material, including but not limited to steel, aluminum, iron, graphite, titanium and other strong and rigid metals, wood, fiber-reinforced materials, plastics. Further, longitudinal bar 12 may be made in any structural form, including but not limited to a bar, a pipe or any of a number structural shapes, including but not limited to bars, pipes, structural tubing, W, S, HP and M shape, channels, and other shapes without departing from the novel scope of the present invention. No limitation on the material or shape of longitudinal bar 12 is intended by the above listing. Further, hand holds 14, of any shape or form may be attached to longitudinal bar 12 in any manner, including, but not limited to, welding, by fasteners, by adhesives, through molding, or other methods, without departing from the novel scope of the present invention.

Pivoting hubs 18 are provided on each end of longitudinal bar 12, and will be described in greater detail below. Support bars 20 intersect pivoting hubs 18, on both ends of longitudinal bar 12, and provide a means to attach longitudinal bar 12 to a recreation device 5 or to a support structure 22. Support bars 20 may be attached to support structures 22 or may be attached to other entertainment devices (not shown) in any manner known to those having ordinary skill in the art, including, but not limited to welding, or with fasteners or adhesives. Support bars 20 are illustrated as members having a circular cross-section, such as pipe sections, however, it is to be understood that support bars 20 may be of any structural shape, including, but not limited to, bars, pipes, structural tubing, W, S, BP and M shape, channels, and other shapes without departing from the novel scope of the present invention. Further, climbing device 10 of the present invention may be attached between two recreational structures such that climbing device 10 forms a span between two such entertainment devices. It is to be understood that longitudinal bar 12, while shown as placed generally horizontally, may be placed at an inclined angle, to provide an added climbing dimension to the device without departing from the novel scope of the present invention.

Figure 5:
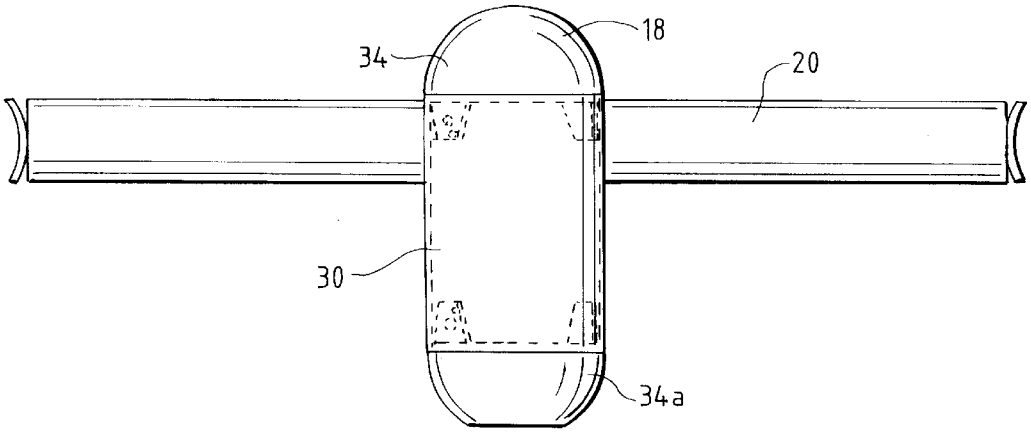
FIG. 5 is a cut away plan view of the top of the pivoting hub and bar of an embodiment of the device of the present invention.
Figure 6:
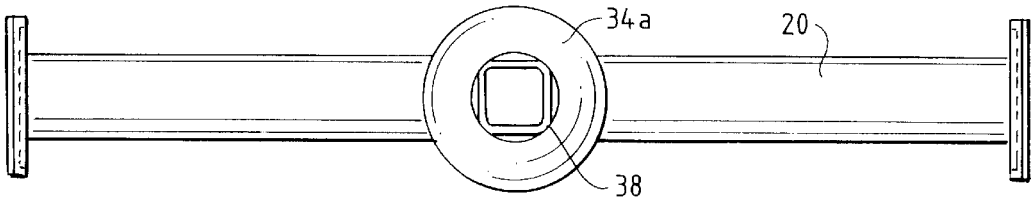
FIG. 6 is an elevational view of a pivoting hub of the present invention with the longitudinal bar removed therefrom.
Figure 7:
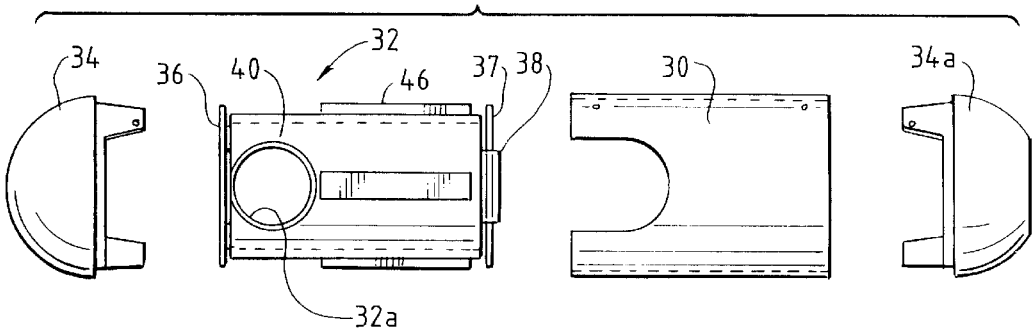
FIG. 7 is an exploded view of a pivoting hub of the present invention.
Figure 8:
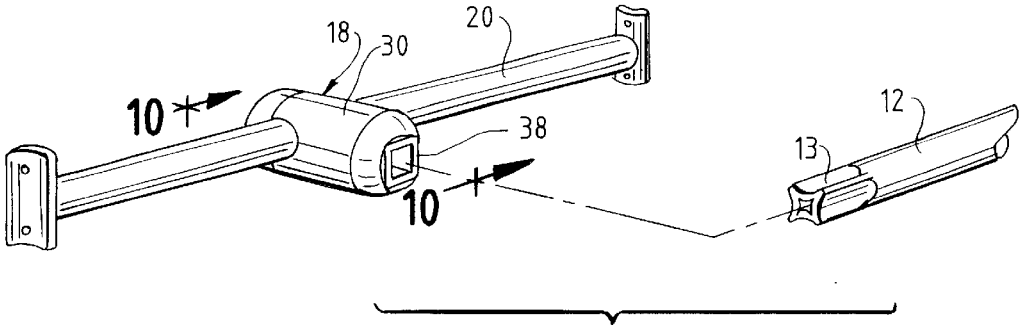
FIG. 8 is an exploded view of a pivoting hub and longitudinal bar of one embodiment of the present invention.
Figure 9:
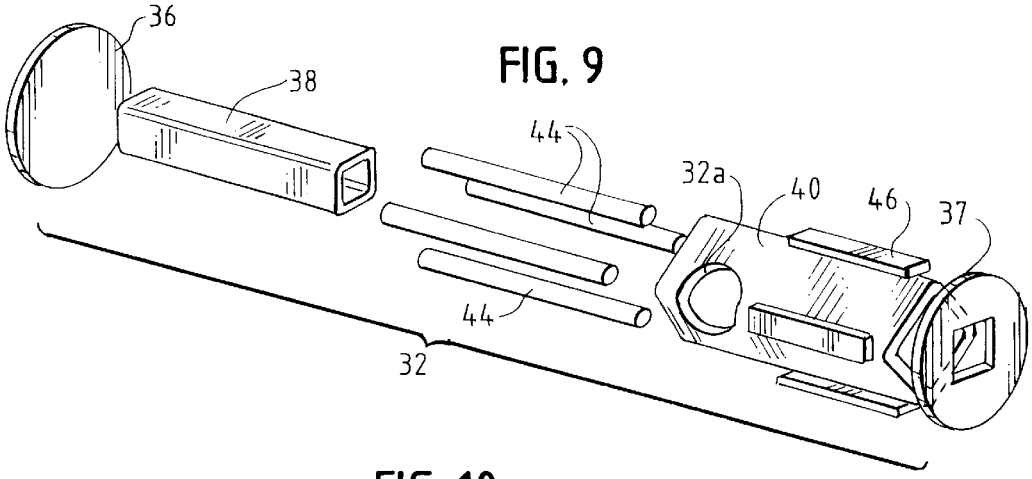
FIG. 9 is an exploded view of a spring element of a pivoting hub of the device of the present invention.
Figure 10:
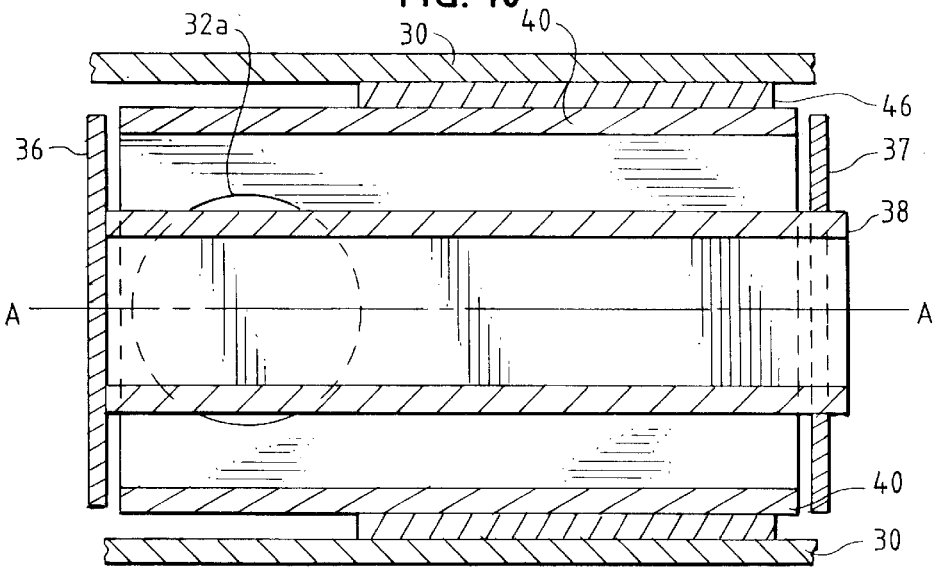
FIG. 10 is a cross-sectional view, taken along the line 10—10 of FIG. 8, of the pivoting hub of the device of the present invention.

Pivoting hubs 18 generally provide a point of unification between longitudinal bar 12 and support bars 20 and a pivoting point for the longitudinal bar 12. Longitudinal bar 12 is fitted at each end with end bars 13, each having a generally star-shaped cross-section. Pivoting hubs 18, having a cooperating element, which will be discussed below, is fitted over the ends of bar 13. As seen in FIGS. 5 through 10, a pivoting hub 18 comprise a cover 30, a spring assembly 32 defining an opening 32*a* through which support bar 20 can be threaded, a closed end cap 34 and an open end cap 34*a*. Spring assembly further comprises a closed end plate 36, an open end plate 37, a tube section 38, having a generally square cross-section, a rubber sleeve 40, having a generally square cross-section, an end plate defining a hole 42, four cylindrical rubber spring members 44 and cap fitting strips 46. Pivoting hub 18, therefore, comprises generally square tube section 38, initially in a first position concentrically within generally square rubber sleeve 40.

Tube section 38, in a first, at rest, position, is rotated, relative to rubber sleeve 40, about 45 degrees, such that tube section corners 38*a* are adjacent to square sleeve sides 40*b*. Rubber spring members 44, are placed at each internal corner 40*a* of rubber sleeve 40 such that spring members 44 are between corners 40*a* and square sleeve sides 38*b*. Spring members 44 are comprised of somewhat rigid elastic rubber such that compression and deformation in the presence of pressure occurs, while the material retains resilience. In a preferred embodiment of the present invention, rubber spring members 44 are frozen to cause the rubber material to contract. The frozen spring members 44 are then placed within sleeve corners 40*a* and square tube 38 is placed in its first position, concentrically within sleeve 40. As spring members 44 thaws the rubber material expands forming a tight fit between sleeve 40, spring members 44 and square tube 38. Thereafter, a friction fit between sleeve 40, spring members 44 and tube 38 keeps spring members 44 from rotating within sleeve 40. It is to be understood that other methods of installing and maintaining spring members 44 within sleeve 40 may be used without departing from the novel scope of the present invention. Such methods of maintaining spring members 44 within sleeve 40 such as by use of adhesives, or molding spring members 44 as part of sleeve 40 are contemplated, and do not present a departure from the novel scope of the present invention.

In the operation of the device of the present invention, longitudinal bar 12 and end bar 13, inserted into square tube 38 within pivoting hub 18, are in a first, at rest position, when a user 2 grasps one of a plurality of hand holds 14. The weight of the user causes grasped hand hold 14 to pivot down, rotating longitudinal bar 12 and end bar 13. End bar 13, attached within square tube 38, causes tube 38 to rotate, further causing each corner 38*a* of tube 38 to rotate towards and against a spring member 44. The rotation of each corner 38*a* into a spring member 44 causes each spring member 44 to compress and deform. Deformation of spring member 44 continues until corner 38*a* cannot rotate further, thus limiting the degree to which hand hold 14 can pivot, typically limiting the pivoting to between 1 and 3 inches. The compression of spring member 44 creates potential energy which allows longitudinal bar 12 to return to its first, at rest, position upon the release of hand holds 14.

These elements work together to allow longitudinal bar 12 to be connected to support bar 20 while allowing longitudinal bar 12 to pivot with respect to support bars 20. Further, the combination of these parts allows longitudinal bar 12 to pivot such that hand holds 14 may drop, relative to the horizontal plane of longitudinal bar 12, approximately 1 to 3 inches. In this manner the user is given a limited rotation that requires the user to exercise strength and agility to traverse the device. The use of spring member 44, having a durometer of around 65, causes a spring action, resulting in hand holds 14 returning to a generally horizontal-to-the-ground position, upon the release of hand holds 14.

It is to be understood that other methods, known in the art, allowing longitudinal bar 12 to pivot with respect to support bars 20 may be used without departing from the novel scope of the present invention.

Although an illustrative embodiment of the invention has been shown and described, it is to be understood that various modifications and substitutions may be made by those skilled in the art without departing from the novel spirit and scope of the invention.

What is claimed is:

1. An overhead hand-over-hand traversing apparatus comprising;

a longitudinal bar, defining an axis of rotation and a vertical plane, extending through the center of said bar perpendicular to the ground, said bar having a proximal end and a distal end and being supported at said proximal and distal ends, said bar having a first pivoting hub and a second pivoting hub, respectively, at said proximal and distal ends;

a plurality of hand bars, spaced apart along the length of said longitudinal bar and attached on both sides of said vertical plane, such that a user can traverse the length of the longitudinal bar by first grasping one of said plurality of hand bars, near said proximal end of said longitudinal bar, with one hand, and another of said plurality of hand bars with a another hand, and subsequently releasing, one at a time, each grasped hand bar to grasp another of said plurality of hand bars;

said first and second pivoting hubs causing said longitudinal bar to pivot about a limited angle of rotation on said longitudinal axis, as hand bars are grasped wherein said pivoting hubs comprise a spring element such that said longitudinal bar is returned to a first unpivoted position when said hand bars are released.

2. The overhead hand-over-hand traversing apparatus of claim 1, wherein said spring element comprises a rubber sleeve having a square cross section, a rigid tube having a square cross-section, placed within said rubber sleeve and a plurality of rubber cylinders placed between said rubber sleeve and said rigid tube, such that when said rigid tube is rotated from a first, at rest, position, said rubber cylinders are compressed such that rotation of said rigid tube, within said rubber sleeve, and said longitudinal bar are limited to no more than 45 degrees.

3. The overhead hand-over-hand traversing apparatus of claim 2, wherein said compression of said rubber cylinders creates potential energy to return said rigid tube and longitudinal bar to said at rest position.

4. The overhead hand-over-hand traversing apparatus of claim 1, wherein said hand bars can pivot between 1 and 4 inches when said longitudinal bar pivots.

5. The overhead hand-over-hand traversing apparatus of claim 1, wherein said hand bars are placed, alternately on opposite sides of said vertical plane.

6. The overhead hand-over-hand traversing apparatus of claim 5, wherein said hand bars comprise generally U-shaped structural members and said hand bars are attached, at the ends of said U-shape, to said longitudinal bar.

7. The overhead hand-over-hand traversing apparatus of claim 1, wherein said pivoting hubs are supported by cross-bars.

8. The overhead hand-over-hand traversing apparatus of claim 7, wherein said cross-bars are attached to ladder-like supports.

9. The overhead hand-over-hand traversing apparatus of claim 7, wherein said cross-bars are attached to recreational elements and said hand-over-hand traversing apparatus spans between said recreational elements.

10. The overhead hand-over-hand traversing apparatus of claim 1, wherein one end of said longitudinal bar is supported at a higher altitude than the other end, such that said longitudinal bar is inclined.

11. The overhead hand-over-hand traversing apparatus of claim 1, wherein said longitudinal bar is constructed of a structural pipe.

12. The overhead hand-over-hand traversing apparatus of claim 1, wherein said hand bars are constructed of structural pipe.

13. The overhead hand-over-hand traversing apparatus of claim 1, wherein said longitudinal bar and said hand bars are constructed of a rigid and durable material.

14. The overhead hand-over-hand traversing apparatus of claim 1, wherein said longitudinal bar and said hand bars are constructed of metal.

15. The overhead hand-over-hand traversing apparatus of claim 1, wherein said longitudinal bar and said hand bars are constructed of steel.

16. The overhead hand-over-hand traversing apparatus of claim 1, wherein said longitudinal bar and said hand bars are constructed of plastic.

17. The overhead hand-over-hand traversing apparatus of claim 1, wherein said longitudinal bar and said hand bars are constructed of wood.

18. An overhead hand-over-hand traversing apparatus comprising;

a longitudinal bar, defining an axis of rotation and a vertical plane, extending through the center of said bar perpendicular to the ground, said bar having a proximal end and a distal end and being supported at said proximal and distal ends, said bar having a first pivoting hub and a second pivoting hub, respectively, at said proximal and distal ends, said pivoting hubs: comprising a spring element;

a plurality of hand bars, said hand bars comprise generally U-shaped structural members, said hand bars being attached, at the ends of said U-shape, to said longitudinal bar, spaced apart along the length of said longitudinal bar and placed alternately, on opposite sides of said vertical plane, such that a user can traverse the length of said longitudinal bar by first grasping one of said plurality of hand bars, near said proximal end of said longitudinal bar, with one hand, and another of said plurality of hand bars with a another hand, and subsequently releasing, one at a time, each grasped hand bar to grasp another of said plurality of hand bars, said first and second pivoting hubs causing said longitudinal bar to pivot about a limited angle of rotation, on said longitudinal axis, such that said hand bars may pivot between one and three inches, as hand bars, on opposite sides of said vertical plane, are grasped, and said longitudinal bar is returned to a first unpivoted position when said hand bars are released.

19. The overhead hand-over-hand traversing apparatus of claim 18, wherein said pivoting hubs are supported by cross-bars.

20. The overhead hand-over-hand traversing apparatus of claim 18, wherein one end of said longitudinal bar is supported at a higher altitude than the other end, such that said longitudinal bar is inclined.

21. The overhead hand-over-hand traversing apparatus of claim 18, wherein said longitudinal bar is constructed of a structural pipe.

22. The overhead hand-over-hand traversing apparatus of claim 18, wherein said hand bars are constructed of structural pipe.

23. The overhead hand-over-hand traversing apparatus of claim 18, wherein said longitudinal bar and said hand bars are constructed of a rigid and durable material.

24. The overhead hand-over-hand traversing apparatus of claim 18, wherein said longitudinal bar and said hand bars are constructed of metal.

25. The overhead hand-over-hand traversing apparatus of claim 18, wherein said longitudinal bar and said hand bars are constructed of steel.

26. The overhead hand-over-hand traversing apparatus of claim 18, wherein said longitudinal bar and said hand bars are constructed of plastic.

27. The overhead hand-over-hand traversing apparatus of claim 18, wherein said longitudinal bar and said hand bars are constructed of wood.

* * * * *